United States Patent [19]

Miki et al.

[11] 4,252,174

[45] Feb. 24, 1981

[54] METHOD AND APPARATUS FOR MONITORING THE OPERATION OF A RECIPROCATING LIQUID INJECTION UNIT

[75] Inventors: Isao Miki, Shimizu; Takeshi Kishihara, Fuji; Hiroaki Mori, Shizuoka; Tsutomu Nagi, Shimizu, all of Japan

[73] Assignee: Nippon Light Metal Research Laboratory Limited, Tokyo, Japan

[21] Appl. No.: 971,399

[22] Filed: Dec. 20, 1978

Related U.S. Application Data

[63] Continuation of Ser. No. 789,257, Apr. 20, 1977, abandoned.

[30] Foreign Application Priority Data

Apr. 26, 1976 [JP] Japan ..... 51-46492

[51] Int. Cl.[3] ..... B22D 2/00; B22D 17/32

[52] U.S. Cl. ..... 164/4; 164/151; 164/153; 164/314; 425/154; 425/171

[58] Field of Search ..... 164/4, 150, 151, 153-155, 164/312, 314, 315; 425/136, 154, 169, 171, 557, DIG. 45; 192/150; 100/53; 264/40.1; 73/9, 49.4, 52, DIG. 9; 91/1; 137/551

[56] References Cited

U.S. PATENT DOCUMENTS

| | | | |
|---|---|---|---|
| 2,950,501 | 8/1960 | Harkenrider | 425/557 X |
| 3,078,515 | 2/1963 | Wintriss | 425/154 X |
| 3,330,003 | 7/1967 | Eggenberger et al. | 164/315 X |
| 4,029,122 | 6/1977 | Jaegtnes | 91/1 X |

*Primary Examiner*—R. L. Spruill
*Assistant Examiner*—J. Reed Batten, Jr.
*Attorney, Agent, or Firm*—William J. Daniel

[57] ABSTRACT

A method and apparatus for monitoring the operation of a reciprocating liquid injection unit wherein charges of an injection liquid, such as molten metal, are injected one-by-one to a point of consumption, such as an injection molding die, by an injection plunger reciprocating in a sleeve and driven by a double acting hydraulic cylinder and fluctuations in the oil pressure on the return side of the hydraulic cylinder are monitored to detect abnormal increases in such pressure which indicate the occurrence of dragging between the injection sleeve and the plunger head.

10 Claims, 5 Drawing Figures

METHOD AND APPARATUS FOR MONITORING THE OPERATION OF A RECIPROCATING LIQUID INJECTION UNIT

This is a continuation of Ser. No. 789,257, filed Apr. 20, 1977 and now abandoned.

BACKGROUND OF THE INVENTION

1. Field of the Invention

The present invention relates to a method and apparatus for monitoring the operation of a reciprocating liquid injection system as for the injection molding of molten metal, such as molten aluminum, and has for its objective the provision of a method and apparatus wherein an undesirable operating condition can be promptly detected.

2. Description of the Prior Art

It is known to produce various articles by die casting and like methods by injecting a molding liquid, i.e. molten metal such as aluminum, into molds with an injection system. According to the injection die casting method, a molding liquid, e.g. a molten metal, is delivered within an injection sleeve communicating with an inlet of the mold and is injected into a mold cavity by a plunger which is reciprocated by a hydraulic operating cylinder. This method is widely employed for the mass production of machine parts and other articles of daily use because it is possible with this method to cast continuously and automatically shaped articles of high dimensional accuracy. However, during the repeated operation of this kind of injection mechanism, molten metal can adhere to the interior of the sleeve or the plunger head or tip slidably reciprocating therein, resulting in a reduction in the working clearance between the sleeve and head, which causes a phenomenon known as "dragging" to occur between the sleeve and plunger head. Continued operation in the system while in this state can lead to serious problems, for example, the sliding surfaces of the sleeve and head can be injured, and as the dragging phenomenon tends to grow worse gradually, the quality of the molded products suffers and the molding mechanism can be damaged intensively. Therefore, in order for the injection molding to be carried out smoothly and properly, it is important that when such an operating failure occurs, this phenomenon be detected reliably at an early stage of its existence so that appropriate action can be taken to eliminate its cause. However, since this phenomenon takes place inside the injection sleeve while the casting operation is performed automatically by the hydraulic drive cylinder, it is difficult to precisely detect its occurrence externally and, consequently an acceptable solution to this problem has not yet been devised.

SUMMARY OF THE INVENTION

An object of the present invention is to provide a method and apparatus for monitoring the operation of a molten liquid injection system, in which the drawbacks described above are eliminated. The solution constituting the present invention originated with the inventors following careful study and a number of practical experiments. That is to say, as the result of detailed studies on the reasons why the above-identified operating failures occur, it has been found that there are a variety of causes for their occurrence, and the principal ones are, for example, overheating of the head due to an interruption or reduction in the supply of cooling water for the head, failure to smear the head with lubricant, intrusion by molten metal into the clearance between the sleeve and head, all of which involve some kind of failure within the sleeve. These studies have led to the perception that the hydraulic cylinder for driving the plunger should be observed and analyzed as to loads imposed thereon during operation. First, an evaluation has been made on the operation of the hydraulic drive cylinder in order to detect the level of working oil pressure during the forward motion of the cylinder when actual injection occurs. It has been found that if there is a change at all in the oil pressure during the advance of the cylinder due to the occurrence of an operating failure, the extent of said change is very small at the early stages of the failure in comparison to the normal working pressure and that such change cannot be reliably determined until the dragging had already advanced remarkably. Therefore, it was impossible to detect the occurrence of the operation failure and take appropriate counter measures.

Next, the operation of the cylinder was analyzed with regard to changes in working oil pressure within the cylinder during its return stroke and after completion of injection, and from this study, it became apparent that the occurrence of an operating failure was manifested very clearly as a change in working cylinder pressure. The reason why the occurrence of an operating failure reveals itself as a distinct pressure change on the return side of the cylinder is believed to be because this return motion takes place after the head had already injected the molten metal and is hence not subject to the loading due to the injection of molten metal in contrast to the forward stroke of the cylinder.

DETAILED DESCRIPTION OF PREFERRED EMBODIMENT

Figure 1:
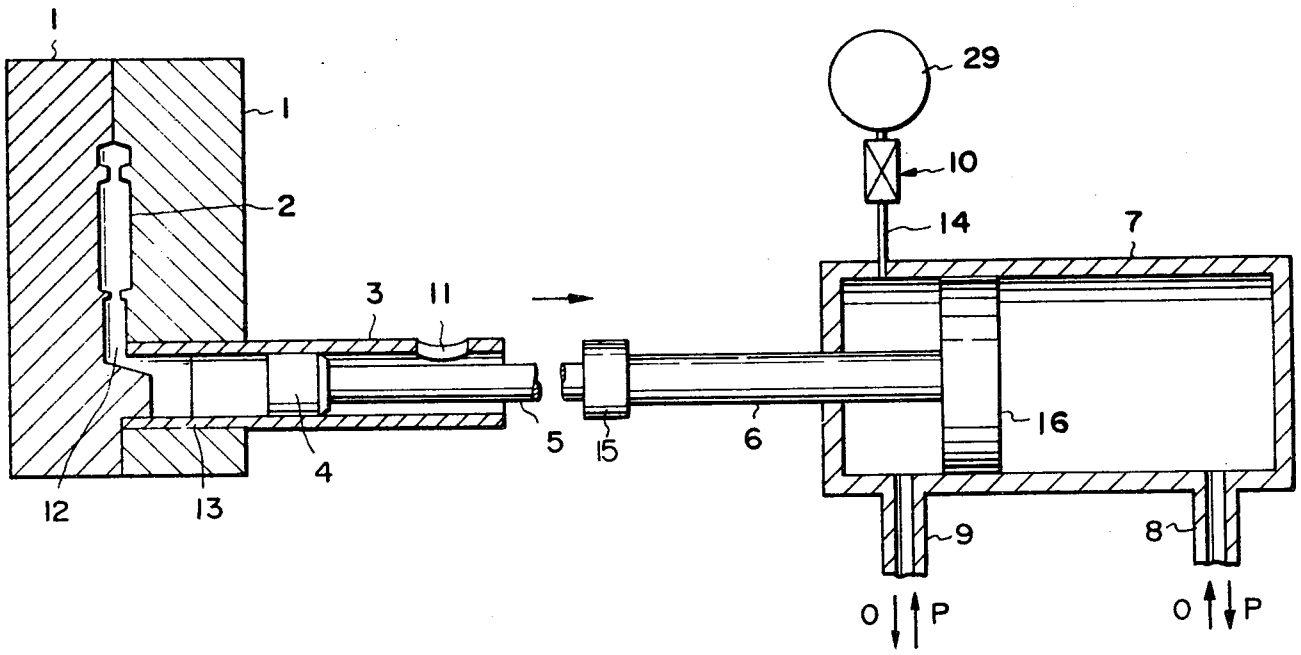
FIG. 1 is a schematic sectional view of one conventional injection molding system modified for the practice of the method of the present invention.

An example of an apparatus used in the method of the present invention includes, as shown in FIG. 1, a pair of complementary molds 1, 1 which defines between them a cavity 2; and an injection sleeve 3 communicating at its front end with the cavity 2 through a gate 12 and held in place by a mounting section 13. The sleeve 3 is provided adjacent the end remote from molds 1 with a casting opening 11 for the introduction therein of a casting liquid, e.g. molten metal. When a plunger head 4 reciprocates in sleeve 3 by means of a plunger rod 5, and when head 4 is at the rear or outermost point of its stroke, a predetermined amount of casting liquid is fed or loaded into the sleeve 3 by any suitable means (not shown) and after the sleeve is loaded the head 4 is advanced to forcibly inject the molding liquid into cavity 2 wherein it is molded in the shape of that cavity.

A hydraulic cylinder 7 functions to drive the head along a reciprocating path through the plunger rod 5 which is connected by means of a coupling device 15 to a cylinder rod 6 fixed to a piston 16 within cylinder 7. The driving cylinder 7 communicates on the far or rear side of piston 16 with a hydraulic oil line 8 for its forward injection stroke and on its near or front side with a hydraulic oil line 9 for its return or retraction stroke. The apparatus described up to this point is of known conventional design and operates in a known manner. That is to say, when hydraulic oil flows in lines 8 and 9 in the direction of arrow O as seen in FIG. 1; the head 4 is advanced by the piston 16; and when the oil flows in the opposite direction of arrow P, the piston is moved backwardly and head 4 is retracted. According to the present invention, this construction is modified by the provision of a detecting line 14 communicating with the interior of cylinder 7 on the near or front side of piston 16 in the same general region as line 9, and the working level of the oil pressure on that side of the cylinder is monitored by a pressure transducer 10 or other fluid pressure observing means for detecting changes in the instantaneous oil pressure acting on the piston 16 during retraction of head 4, which appear at indicator 29.

Figure 2:
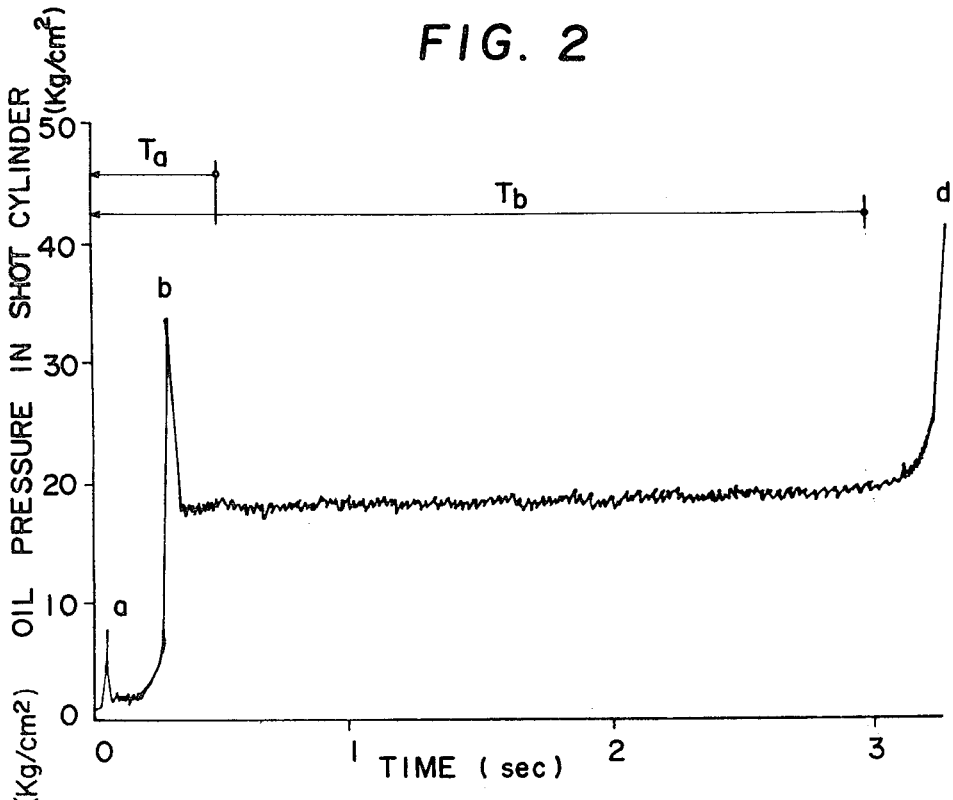
FIG. 2 is a graph showing the relationship between the return time of the plunger head and the oil pressure on the return side of the cylinder measured during a normal operation.
Figure 3:
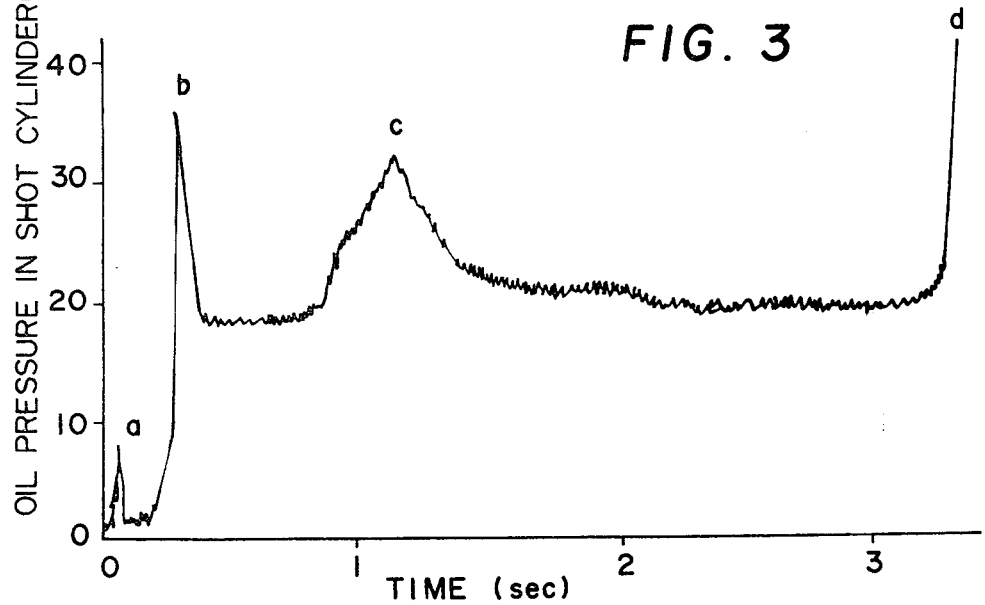
FIG. 3 is a view similar to FIG. 2 measured during an abnormal operation in which a dragging phenomenon occurs.

FIGS. 2 and 3 are graphs plotting changes in oil pressure within the return side of the hydraulic cylinder 7 driving the injection plunger as a function of time starting with the plunger in the extreme forward position immediately upon completion of the injection, as recorded by an oscillograph during the casting of molten aluminum by a 250 ton die casting machine. In each of FIGS. 2 and 3, the abscissa shows the elapsed returning time in seconds and the ordinate shows the oil pressure in the hydraulic cylinder in kg/cm$^2$. FIG. 2 represents the normal operative condition and shows two pressure peaks occurring at the beginning of the return motion of the plunger. Peak (a) is an initial shock as hydraulic fluid enters the cylinder while the plunger begins to move in a practical sense starting with peak (b). Under normal operation without the occurrence of dragging between the injection sleeve and the plunger head as shown in FIG. 2, the cylinder pressure remains almost constant during retraction of the plunger until it rises sharply to peak (d) about the time when the plunger has completed its return.

FIG. 3 illustrates the effect on cylinder oil pressure where the dragging occurs between the sleeve and the head during retraction of the plunger. As shown in FIG. 3, when such dragging takes place, there appears an additional peak (c) in the otherwise flat portion of the oil pressure curve. Although this peak (c) is small at first, if operation is continued in such a state the dragging becomes aggravated and the peak (c) gradually increases in magnitude.

Figure 4:
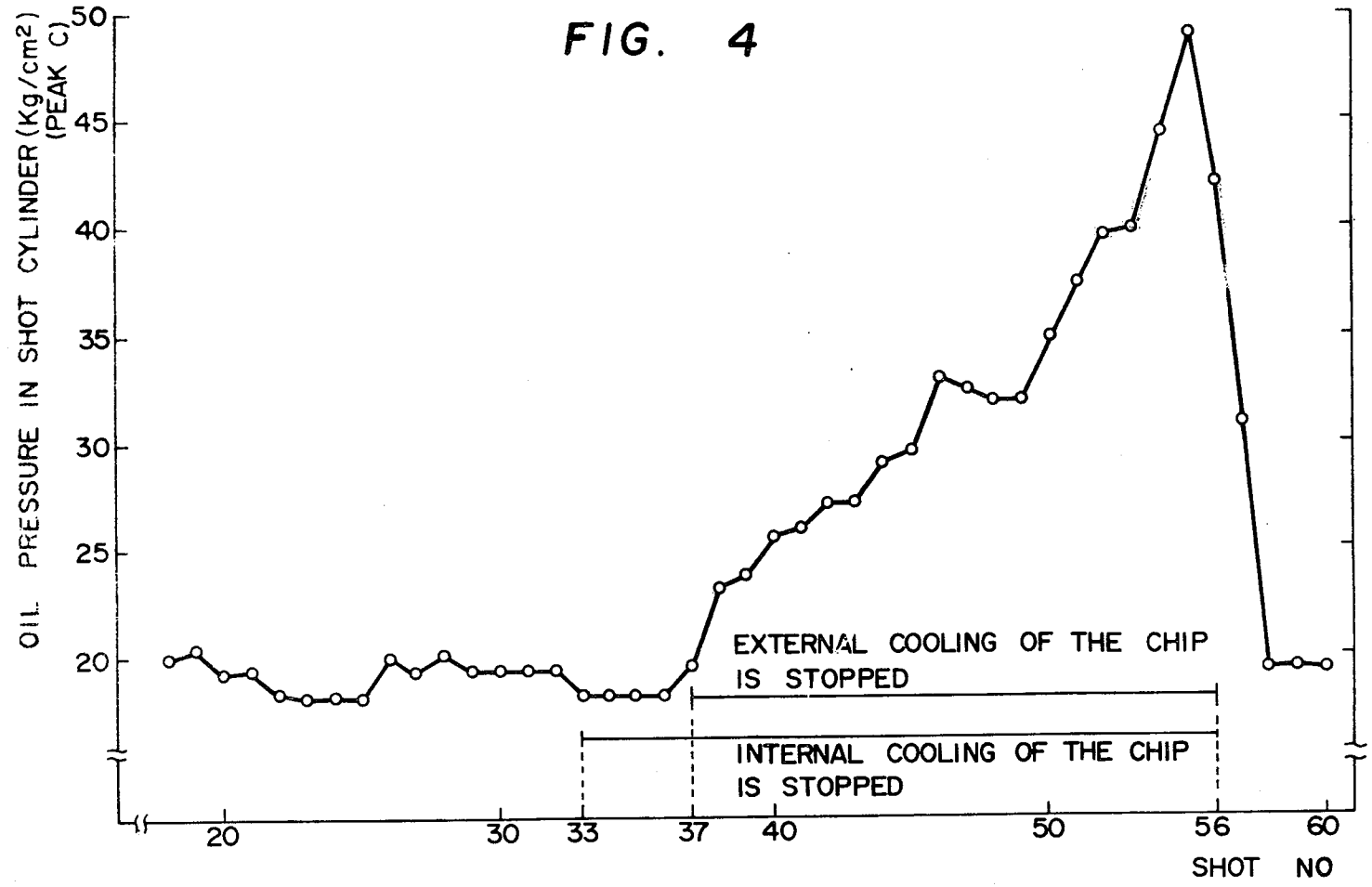
FIG. 4 is a plot of peak cylinder pressure for a sequence of 60 casting cycles during which sequence operating failures occur and are corrected.

FIG. 4 is a graph showing how the maximum pressure level (peak c) in the oil pressure curve changes where the dragging is created intentionally during the course of a continuous sequence of casting operations. Shots No. 1–33 correspond to normal operations with the head being water-cooled as usual and a maximum cylinder pressure about 20 kg/cm$^2$ throughout these shots. After the shot No. 33, the internal cooling of the head was stopped and the external cooling was stopped at shot No. 37. The peaks (c) of the oil pressure curve record increasingly higher pressure values starting at these points, which indicated that the dragging in the sleeve gradually increased in severity. At shot No. 56 the oil pressure had reached 50 kg/cm$^2$. The head was then cooled again with water for shot No. 57, and the oil pressure curve returned quickly to its original values so that it was indicated to have eliminated the dragging.

Figure 5:
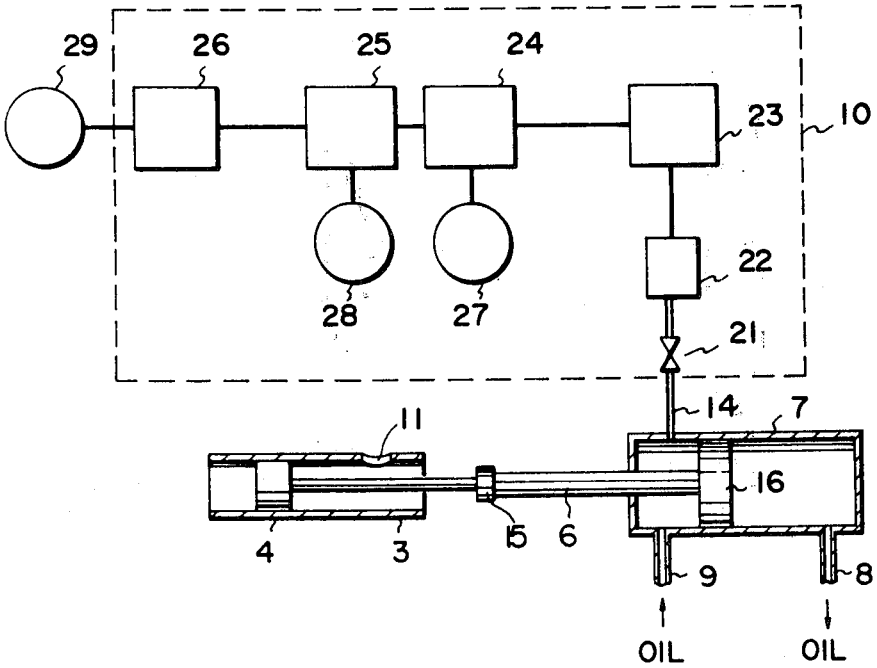
FIG. 5 is a diagrammatic view of one apparatus for monitoring cylinder oil pressure for purposes of this invention.

In FIG. 5 there is shown as an example one form of a complete apparatus for monitoring excessive oil pressure in the hydraulic cylinder during the return motion of the working piston therein in accordance with the present invention. In FIG. 5 the pressure detecting line 14 includes a cut-off valve indicated at 21 and leads to a pressure transducer head 22. The oil pressure in the cylinder during return of the piston is measured in pressure head 22 in terms of an analogous voltage corresponding to instantaneous oil pressure. This voltage is delivered to a voltage sensor 23 which generates when there is applied to it a voltage higher than a predetermined voltage an output signal current actuating a relay 26 which in turn sets off an alarm 29 (which can include a signal light) to give audible and/or visible warning of the occurrence of an abnormal condition. Timers 27 and 28 are connected to relays 24 and 25, respectively, interposed in series between sensor 23 and relay 26. These timers are used for preventing relay 26 from being actuated by a high voltage produced at the beginning of the return motion of the plunger (i.e. corresponding to peak (b) in FIG. 2) or a high voltage produced at the end of the return motion of the plunger (corresponding to peak (d) in FIG. 2) and de-activating alarm 29 at these stages. Timers 27 and 28 are cycled automatically at the same time hydraulic oil is supplied to the return side of the driving cylinder and set relays 24 and 25, respectively on and off after the lapse of predetermined times (equal to Ta and Tb seen in FIG. 2). Thus, relays 24 and 25 are used for avoiding the creation of an alarm due to the high voltages (peaks (b) and (d)) normally produced at the beginning and end of the return motion of the plunger so that only a signal produced by an abnormal pressure condition (peak (c)) caused by the dragging is received by relay 26 to operate the alarm 29 and give the desired warning.

The method of the present invention will be described in an example which had been practiced under using a 250 t injection molding die cast machine operating with a molten alloy at a temperature of about 650° C. The difference in the diameters of the sleeve 3 and plunger head 4 is about 0.18 mm at normal temperature. Under these conditions 500 separate injection molding operations were carried out. Up to about 350 operations, the maximum cylinder pressure during the return motion was about 20 kg/cm$^2$ (practically about 18.5–23.5 kg/cm$^2$), thereafter it rose gradually, and at the 378th injection molding a pressure of 25.5 kg/cm$^2$ was observed and the alarm lamp was lighted. Then, after investigating the cause of the failure, it was determined that there was a trouble in the supply of the interior and exterior cooling water. The cause of this trouble was eliminated and operations were continued, the cylinder return pressure after injection was started again being at a maximum pressure of about 19 kg/cm$^2$. It had reached about 23.5 kg/cm$^2$ by the 426th operation, but at the 427th and 428th operations the maximum pressure rose to 44 kg/cm$^2$ and 48.5 kg/cm$^2$, and the alarm lamp was lighted to indicate an obvious failure. In this instance it was found that molten metal had penetrated into the clearance between the sleeve 3 and head 4. When this cause of failure was eliminated and the injection molding was further carried out, the maximum pressure returned to its original value of about 20 kg/cm$^2$ and the molding proceeded smoothly.

While the invention has been described specifically in the context of a molten metal injection system, it will be apparent that it would find utility with any reciprocating injecting unit.

What is claimed is:

1. A method for monitoring the operation of a reciprocating injection mechanism in an injection molding operation in which an injection plunger is reciprocated in a sleeve, which method comprises the steps of measuring the force applied to said plunger substantially throughout the entirety of its return stroke and detecting when said force increases significantly above a predetermined normal operating range.

2. The method of claim 1 wherein said plunger is connected to a piston and hydraulic fluid is applied to the opposite side of said piston to reciprocate said plunger and said force is measured by means of the pressure of said hydraulic fluid on the return side of said piston during its return stroke.

3. The method of claim 1 including the steps of operating an indicating means in response to the detection of an excessive force to provide an indication of the occurrence of an abnormal operating condition.

4. The method of claim 1 including the step of providing an audible or visible alarm when said force is detected to be excessive.

5. The method of claim 3 including the step of disabling said indicating means at the beginning and end of said return stroke to avoid a false indication due to the normal increases in applied force at those operating stages.

6. A reciprocating injection apparatus comprising an injection molding casting die; means for injecting a moldable material into said casting die including an injection sleeve communicating at one end with the interior of said die and adapted to receive said moldable material, an injection plunger reciprocating in said sleeve and drive means connected to said plunger for driving said plunger; means operatively associated with said plunger and operating during the return stroke of said plunger for measuring the force applied to said plunger substantially throughout the entirety of its return stroke; and means operatively associated with said force measuring means for detecting when said measured force exceeds a predetermined normal operating range.

7. The apparatus of claim 6 wherein said plunger driving means comprises a hydraulic cylinder having the piston thereof connected to said plunger, means for alternatively supplying pressurized hydraulic fluid to and exhausting such fluid from the injection and return sides of said cylinder to reciprocate said piston and plunger, and said measuring means is operatively connected to said return side of said cylinder and measures the force on the return side of said piston during the return stroke thereof.

8. The apparatus of claim 6 wherein said detecting means includes an operatively associated indicating means operated in response to said detecting means.

9. The apparatus of claim 7 wherein said indicating means includes means for providing an audible or visible alarm when said force is detected to be excessive.

10. The apparatus of claim 7 including means for disabling said indicating means at the beginning and end of the return stroke to avoid a false indication due to a normal increase in said applied force at those operating stages.

* * * * *